US005079872A

United States Patent [19]

Short

[11] Patent Number: 5,079,872

[45] Date of Patent: Jan. 14, 1992

[54] TRANSOM ASSEMBLY FOR BATHING ENCLOSURE OR THE LIKE

[75] Inventor: Kevin G. Short, Midlothian, Ill.

[73] Assignee: Sterling Plumbing Group, Inc., Schaumburg, Ill.

[21] Appl. No.: 585,432

[22] Filed: Sep. 20, 1990

[51] Int. Cl.[5] ..... E05D 15/06

[52] U.S. Cl. ..... 49/409; 4/607; 4/609; 4/557

[58] Field of Search ..... 49/409, 410, 411, 380; 4/607, 610, 608, 609, 557, 558

[56] References Cited

U.S. PATENT DOCUMENTS

| | | | |
|---|---|---|---|
| 1,575,083 | 3/1926 | Tracy | 49/409 X |
| 2,756,438 | 7/1956 | Soberman | 84/558 X |
| 2,909,802 | 10/1959 | Gang et al. . | |
| 2,914,775 | 12/1959 | Kauffman | 4/557 |
| 3,189,140 | 6/1965 | Luss | 49/411 |
| 3,702,521 | 11/1972 | Peterson . | |
| 3,827,086 | 8/1974 | Seymour et al. . | |
| 3,995,330 | 12/1976 | Meyers | 4/557 |
| 4,014,378 | 3/1977 | Kochanowski . | |
| 4,148,535 | 4/1979 | Fenwick | 49/410 X |
| 4,325,204 | 4/1982 | Martine . | |
| 4,370,830 | 2/1983 | Schaefer et al. . | |
| 4,398,309 | 8/1983 | Simons . | |
| 4,503,637 | 3/1985 | Parente . | |
| 4,633,614 | 1/1987 | Van Weelden . | |
| 4,754,573 | 7/1988 | van Rooij et al. . | |
| 4,868,935 | 9/1989 | Van Weelden . | |

FOREIGN PATENT DOCUMENTS

| | | | |
|---|---|---|---|
| 935409 | 8/1963 | United Kingdom . | |
| 1178748 | 8/1967 | United Kingdom | 49/411 |
| 2188838 | 10/1987 | United Kingdom | 4/609 |

*Primary Examiner*—Rodney M. Lindsey
*Assistant Examiner*—Jerry Redman
*Attorney, Agent, or Firm*—Quarles & Brady

[57] ABSTRACT

A transom assembly for a bathing enclosure or the like is disclosed. Preferably, multiple sliding transom panels are supported only at their lower end by two upwardly facing channels formed in the lintel or header of the door assembly. The panels may be positioned to overlap and thus create a transom of variable length. Locking ridges in the panels fit locking ridges in the channels to hold the panels against vertical movement. A sealing strip fits within the channels and is held by the locking channels to seal the open portions of the channel when the panels are positioned.

6 Claims, 2 Drawing Sheets

TRANSOM ASSEMBLY FOR BATHING ENCLOSURE OR THE LIKE

BACKGROUND OF THE INVENTION

1. Field Of The Invention

The invention relates to bathing enclosures. It is especially suitable for use with shower enclosures where decorative transom windows are to be installed.

2. Background Of The Art

In some installations the shower door assembly does not extend up all the way to the ceiling. Rather, the track header (or lintel) that supports the door stops several feet below the ceiling. In such installations, it is desired to provide some form of transom (e.g. for privacy and/or to limit the escape of steam or water). However, prior art systems of this type often require unduly complex assemblies. Further, they may be prone to leakage. Also, such assemblies do not readily permit adjustment for different lateral enclosure widths.

Thus, a need exists for an improved transom assembly for use in a bathing environment.

SUMMARY OF THE INVENTION

The present invention provides an adjustable transom assembly to integrate a prefabricated shower door to a shower or bath stall. The transom assembly has a laterally extending lintel holding a track channel having a side opening and a top opening. A transom is received by the track channel, sliding into the side opening. Once in place, the upward motion of the transom panel is restricted by the track channel. The panel and track preferably include interfitting projections and slots which restrict the upward motion of the panels.

In one embodiment, the panel is a window pane and the lower end of the panel includes a bearing sleeve sandwiching the window pane.

In an especially preferred form, the bottom of the lintel includes an integral track for guiding the movement of a shower door.

The objects of the invention therefore include:

a) permitting a fixed height shower door to be aesthetically integrated with transom panels without requiring the use of separate support pieces beyond the lintel used to support the shower door;

b) permitting the use of transom panels of fixed widths with shower stalls of variable widths;

c) efficiently combining a transom panel with a shower door assembly where the components can be easily manufactured and installed; and d) providing a means of minimizing leakage between such adjustable transom panels.

Other objects and advantages besides those discussed above will be apparent to those skilled in the art from the description of a preferred embodiment of the invention which follows. In the description, reference is made to the accompanying drawings, which form a part hereof, and which illustrate one example of the invention. Such example, however, is not exhaustive of the various alternative forms of the invention, and therefore reference is made to the claims which follow the description for determining the full scope of the invention.

DESCRIPTION OF THE PREFERRED EMBODIMENT

Figure 2:
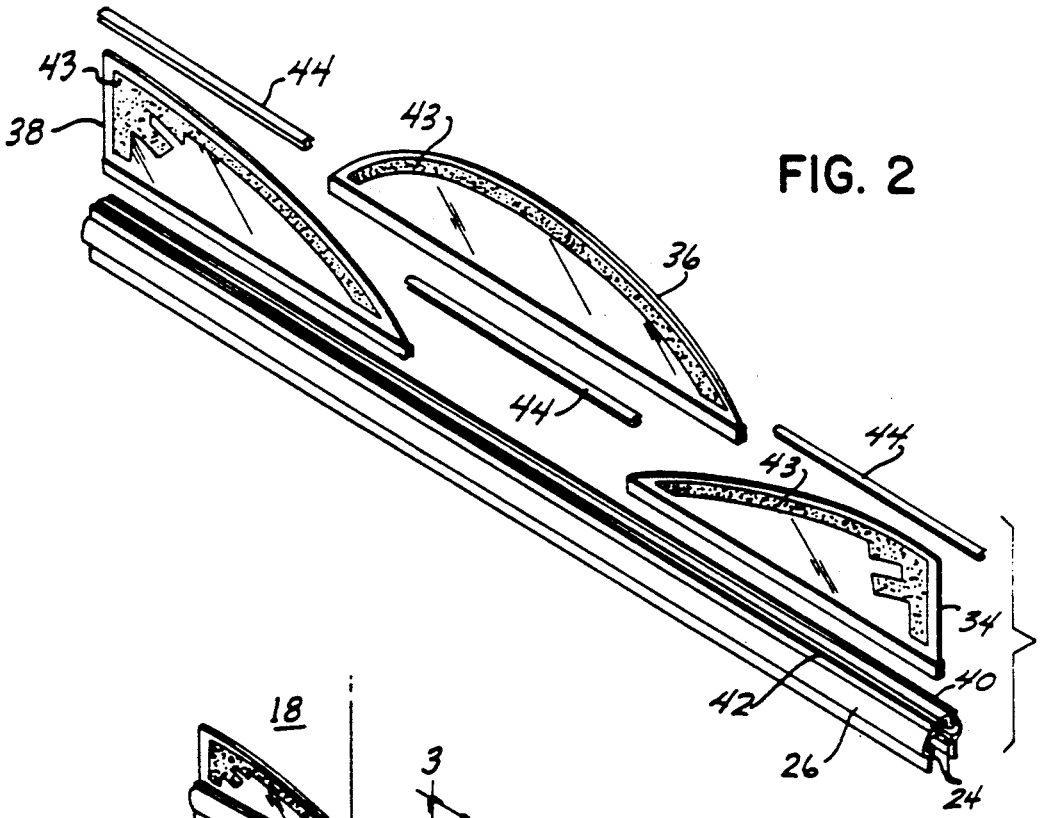
FIG. 2 is an exploded perspective view of the transom assembly of FIG. 1.
Figure 1:
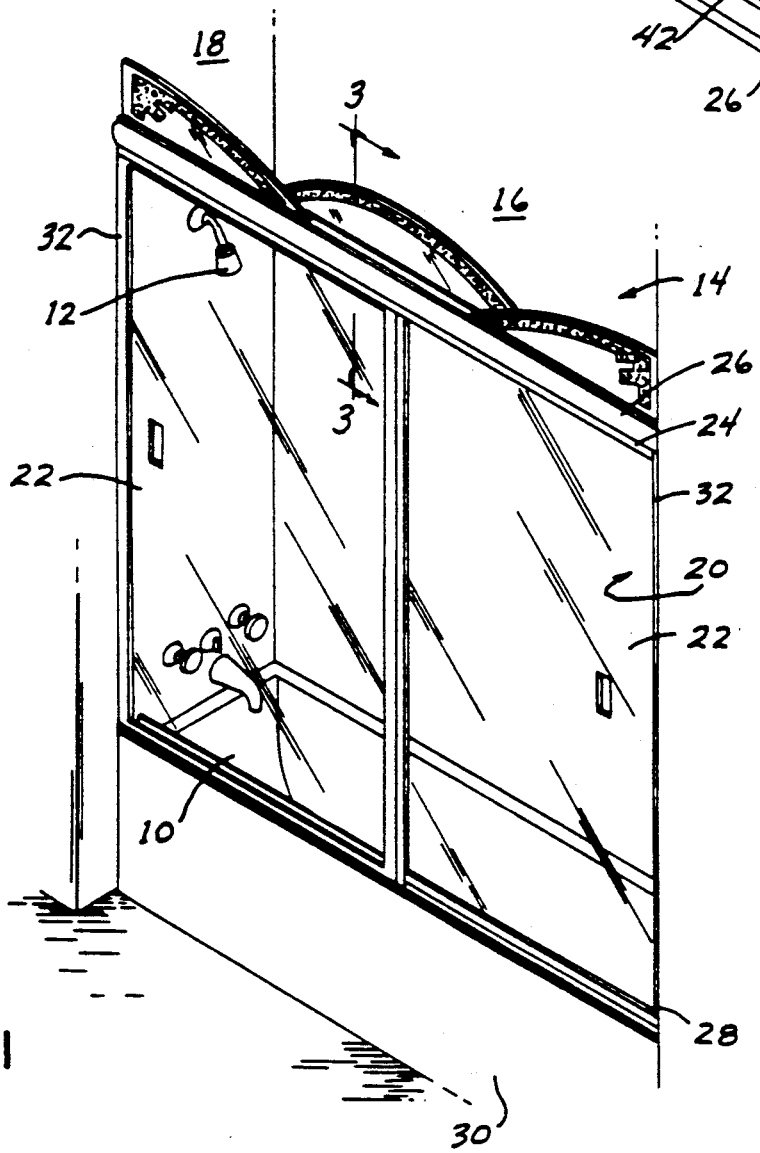
FIG. 1 is a perspective view of a bathing enclosure incorporating the transom assembly of present invention.

Referring to FIG. 1, a bath tub 10 and shower 12 forms part of an alcove or enclosure 14. The enclosure also has a back wall 16 and opposing and parallel side walls 18 and 20. Sliding glass shower doors 22 can be supported and guided in a manner similar to that described in U.S. Pat. No. 4,398,309. In this regard, there are upper tracks 24 supported by a laterally extending lintel 26 and lower tracks 28 affixed to the upper edge of the front apron 30 of the bath tub 10. The upper and lower tracks 24 and 28 are held parallel and spaced apart by wall jambs 32 which extend between the upper and lower track 24 and 28 on each end of those tracks and which are attached to the opposing side walls 18 and 20.

In accordance with the present invention, the top of the lintel 26 is designed to adjustably retain three transom panels 34, 36, and 38 to provide a shield against water and steam from the shower and to give the shower door assembly a fitted and finished look. Importantly, the panels 34, 36, and 38 are vertically oriented and supported at one end only so as to be retained against upward movement. The three transom panels 34, 36, and 38 may slide within lateral upwardly opening channels 40 and 42 in the lintel 26, and thus may visually overlap each other to permit the length of the lintel 26 to be cut to fit different sized alcoves 14 without the need to cut the transom panels 34, 36, and 38.

After the lintel 26 is cut to size, the transom panels 34, 36, and 38 may be distributed along the lintel 26 to fill the space between the opposing side walls 18 and 20. This arrangement allows ready installation of the transom panels 34, 36, and 38 with a variety of preexisting alcoves 14 of varying dimensions and also permits the transom panels 34, 36, and 38 to be fabricated of tempered safety glass which cannot readily be cut on site. The transom panels 34, 36 and 38 are preferably decorated with silk screened designs 43. The length of the channels 40 and 42 that are not occupied by the transom panels 34, 36, and 38 are fitted with special seals 44 as will be further described below.

Figure 3:
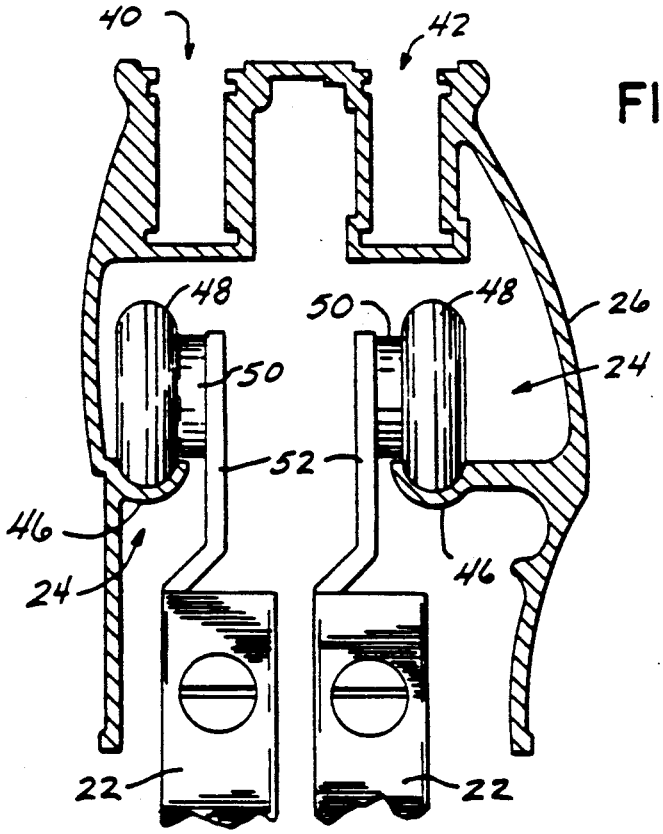
FIG. 3 is a cross sectional view of the header (lintel) of FIG. 1 taken along line 3—3 of FIG. 1.

Referring to FIG. 3, the lintel 26 is formed of an extruded aluminum shape including the channels 40 and 42 which are of generally rectangular cross section, and which extend for the length of the lintel 26 along its top edge. Lintel 26 also opens downward to enclose the upper tracks 24 which comprises two inwardly opposed guide rails 46 having upwardly convex surfaces for receiving rollers 48 supporting the sliding shower doors 22. In the usual fashion, axles 50 attach the rollers 48 to suspension strips 52 which are in turn fixed the pendant shower doors 22.

Figure 4:
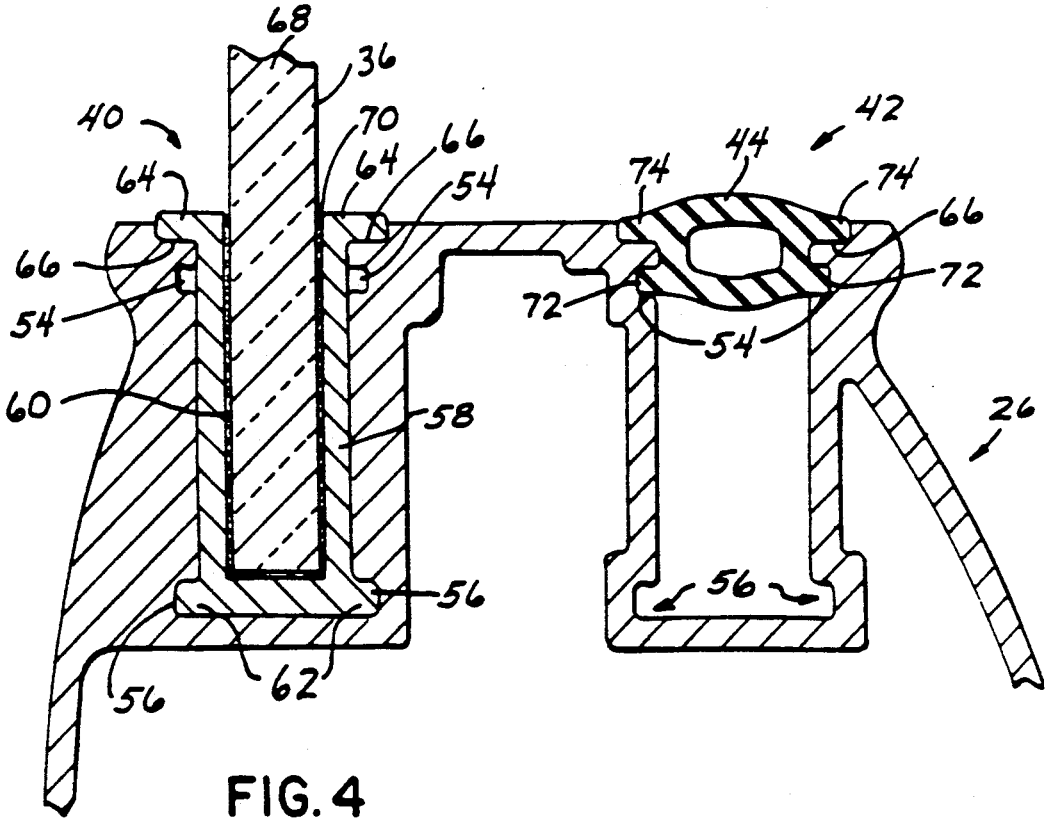
FIG. 4 is a detail of the upper portion of FIG. 3 showing the placement of the transom panels and sealing strips with respect to the lintel.

Referring to FIG. 4, the channels 40 and 42 incorporate upper and lower horizontally opposed locking slots 54 and 56 along the entire length of their inner surface. A sliding bearing sleeve 58 also constructed of extruded aluminum and incorporating an upwardly facing slot 60 of generally rectangular cross section, fits within the upwardly facing channels 40 (or 42) and has lower locking feet 62 corresponding to the lower locking slots 56. An upper shoulder 64 on the bearing sleeve 58 provides a bearing surface fitting against recessed lip 66 at the upper edge of the upwardly facing channels 40 or 44. Accordingly, the bearing sleeve 58 must be inserted into the upwardly facing channels 40 or 44 from the side, and may slide therein but is restrained from vertical movement. The bearing sleeve 58 protects the lower edge of a tempered glass plate 68 which is held in the upwardly facing slot 60 of the bearing sleeve 58 by means of a bead 70 of waterproof space-filling adhesive.

The silk screened design 43 (not shown in FIG. 4) is fused to the glass plates 68 during the tempering process, as is known in the art. Together, the glass plate 68 and bearing sleeve 58 form the transom panels 34, 36, and 38. The glass plate 68 and bearing sleeve 58 move together to allow repositioning of the transom panels 34, 36, and 38.

Additional bearing sleeves 58 may be placed in either channel 40 and 42 to hold additional glass plates 68 The use of two channels 40 and 42 permit the transom panels 34, 6, and 38 to slide into overlapping configurations and thus permit the total length of the combined transom panels 34, 6, and 38 along the lintel 26 to be adjusted to fit an arbitrary dimension between side walls 18 and 20.

The space between adjacent transom panels 34, 36, or 38 in one channel 40 or 42 or the space on either side of a single panel 34, 36, or 38 is preferably sealed with the sealing strip 44 which has locking legs 72 that are received in the upper locking slots 54 of channels 40 and 42 and sealing arms 74 that fit against the upper lips 66 to prevent water and dirt from collecting in the channels 40 and 42.

Installation of the shower door and transom is accomplished by cutting the lintel 26 and lower track 28 to length. The transom panels 34, 36, and 38 are then inserted laterally into the channels 40 and 42 and the lintel 26 and lower track 28 are attached between the side walls 18 and 20 by means of the wall jams 32. The transom panels 34, 36, and 38 are then adjusted to fill the space between the opposing side walls 18 and 20 and the sealing strips 43 are cut and placed in the upwardly facing channels 40 and 42 in the spaces between the transom panels 34, 36, and 38.

The sealing strips 43 can be extruded from a compliant vinyl so as to offer good sealing qualities and so that they may be pressed downward into the upwardly facing channels 40 and 42 without being inserted laterally. The locking legs 72 of the sealing strips 43 are designed to flex inwardly to permit this insertion procedure.

The above description has been that of the preferred embodiment of the present invention. It will occur to those who practice the art that many modifications may be made without departing from the spirit and scope of the invention. For example, the shape and generally arrangement of the transom panels within the channels may be varied according to aesthetic considerations. In order to apprise the public of the various embodiments that may fall within the scope of the invention, the following claims are made.

I claim:

1. A transom assembly for a bathing enclosure, comprising:

a laterally extending lintel having an upper and lower surface;

a laterally extending track channel formed along said upper surface, said channel having at least one side opening and one top opening; and a transom panel configured so that its lower end can be received in the channel by sliding the lower end of the panel into said side opening, whereby after the panel is received into the channel, the upward vertical motion of the panel is restricted by the channel.

2. The assembly of claim 1 wherein one of the lower end and channel has a projection and the other has a slot, and interfitting of the projection and slot restricts upward movement of the panel.

3. The assembly of claim 1, wherein the lower end of the panel comprises a window pane and a bearing sleeve attached to the pane, said bearing sleeve protecting at least portions of a lower edge of the pane, the bearing sleeve being suitable to be sandwiched between the pane and channel when the panel is inserted in the channel.

4. The assembly of claim 1, wherein the lintel is integrally formed with an internal guide track for supporting movement of a shower door, the guide track positioned under the channel.

5. The assembly of claim 1, further comprising an elastomeric sealing strip positionable on an upper edge of the channel.

6. The assembly of claim 1, including:

a second laterally extending track channel formed along said upper surface, said second channel having at least one side opening and one top opening;

a second transom panel configured so that its lower end can be received in the second channel by sliding the lower end of the second panel into said side opening, whereby after the second panel is received into the second channel, the upward vertical motion of the second panel is restricted by the channel, wherein, one of said track channels is in front of the other on the lintel, and both of said panels being shorter in lateral length than the lateral length of the lintel,

* * * * *